US006954027B2

(12) United States Patent
Ko et al.

(10) Patent No.: US 6,954,027 B2
(45) Date of Patent: Oct. 11, 2005

(54) FLAT PANEL DISPLAY HAVING A HORIZONTAL DEFLECTION ELECTRODE WITH HORIZONTALLY ORIENTED ELECTRON BEAM DEFLECTION AREAS

(75) Inventors: Sung Woo Ko, Gumi-si (KR); Nam Jae Koh, Gumi-si (KR); In Jue Kim, Gumi-si (KR)

(73) Assignee: LG. Philips Displays Korea Co., LTD, Gumi-Si (KR)

( * ) Notice: Subject to any disclaimer, the term of this patent is extended or adjusted under 35 U.S.C. 154(b) by 42 days.

(21) Appl. No.: 10/385,685

(22) Filed: Mar. 12, 2003

(65) Prior Publication Data

US 2003/0173888 A1 Sep. 18, 2003

(30) Foreign Application Priority Data

Mar. 12, 2002 (KR) ..... 10-2002-0013243

(51) Int. Cl.[7] ..... H01J 29/70; H01J 29/46

(52) U.S. Cl. ..... 313/422; 313/495; 313/496; 313/413

(58) Field of Search ..... 313/495–497, 313/422, 413, 421; 315/169.4, 169, 364, 365

(56) References Cited

U.S. PATENT DOCUMENTS

| | | | | | |
|---|---|---|---|---|---|
| 4,955,681 | A | * | 9/1990 | Sekihara et al. | 313/495 |
| 5,461,396 | A | * | 10/1995 | Nakatani et al. | 345/75.1 |
| 6,208,072 | B1 | * | 3/2001 | Watanabe et al. | 313/497 |

FOREIGN PATENT DOCUMENTS

| | | | | |
|---|---|---|---|---|
| JP | 53-38260 | | 4/1978 | |
| JP | 53-74357 | | 7/1978 | |
| JP | 54-120582 | A | 9/1979 | |
| JP | 2-250247 | A | 10/1990 | |
| JP | 3-184247 | A | 8/1991 | |
| JP | 3-205751 | A | 9/1991 | |
| JP | 08236044 | A * | 9/1996 | H01J/31/12 |

* cited by examiner

*Primary Examiner*—Karabi Guharay
*Assistant Examiner*—Sikha Roy
(74) *Attorney, Agent, or Firm*—Birch, Stewart, Kolasch & Birch, LLP

(57) ABSTRACT

The present invention relates to a flat panel display, and more particularly, to a flat panel display in which the main skeletal structure of a horizontal deflecting electrode is arranged in a horizontal direction to enhance structural strength and the structure of an electrode to which voltage is applied is shaped symmetric to eliminate over-converging of electron beam.

7 Claims, 11 Drawing Sheets

FLAT PANEL DISPLAY HAVING A HORIZONTAL DEFLECTION ELECTRODE WITH HORIZONTALLY ORIENTED ELECTRON BEAM DEFLECTION AREAS

BACKGROUND OF THE INVENTION

1. Field of the Invention

The present invention relates to a flat panel display, and more particularly, to a flat panel display in which the main skeletal structure of a horizontal deflecting electrode is arranged in a horizontal direction to enhance structural strength and the structure of an electrode to which voltage is applied is shaped symmetric to eliminate over-converging of electron beam.

2. Description of the Related Art

Recently, an electroluminescent display (ELD), a plasma display panel (PDP), a liquid crystal display (LCD) and the like have been developed as a flat panel display. However, in comparison with a cathode ray tube (CRT) that uses an electron beam, the conventional flat panel display has not reached a satisfactory level in view of performances such as luminance, contrast and color reproduction.

To overcome the restrictions of the conventional flat panel display (the ELD, the PDP and the LCD) and implement a high-quality image comparable to the CRT, there have been proposed an improved flat panel display that is based on a screen scanning of an electron beam.

Meanwhile, Japan Laid-open Publications No. 3-184247 and No. 3-205751 disclose an image display apparatus for displaying a high-quality image comparable to the CRT on a flat panel display that uses an electron beam, in which an image displayed on a screen is divided into unit cells constituting a matrix and then an electron beam is deflectively scanned to each unit cell, so that a fluorescent screen is light-emitted to thereby display an entire color image.

FIG. 1 is a view of a conventional color flat panel display based on a screen scanning of an electron beam.

FIG. 1 is an exploded perspective view showing main elements of the conventional color flat panel display. Referring to FIG. 1, the conventional color flat panel display includes a rear glass 1, a rear electrode 2, a filament cathode 3, a control electrode 4, signal modulation electrode 5, a focus electrode 6, a horizontal deflection electrode 7, a vertical deflection electrode 8, and a front glass 9, all of which are arranged one after another. In addition, the rear glass 1 and the front glass 9 are sealed to maintain a vacuum state.

In more detail, the rear electrode 2 is formed of a conductive material such as metal or graphite on a flat panel. The rear electrode 2 is arranged in parallel with the filament cathode 3 and a negative voltage is applied to the rear electrode 2 to thereby cause an electron emitted from the filament cathode 3 to be directed toward the screen.

Generally, the filament-cathode 3 is formed coating an oxide cathode material on a surface of a tungsten wire. At this time, a plurality of filament cathodes are arranged to generate the electron beam constantly distributed in a horizontal direction.

As an electrode for drawing the electron beam 11, the control electrode 4 is spaced apart from the filament cathode 3 by a predetermined distance and disposed in a direction of the screen. Also, the control electrode 4 is faced with the rear electrode 2 and formed of a conductive plate in which passing holes are disposed at each predetermined distance in a horizontal direction and formed on a horizontal line facing each filament cathode 3 by a predetermined distance.

The signal modulation electrode 5 includes a row of conductive plates, each of which is arranged to face each corresponding passing hole of the control electrode 4 and spaced apart from the control electrode 4 by a predetermined distance. At this time, each conductive plate is thin and long, and placed in a vertical direction. Each of the conductive plates of the signal modulation electrode 5 has passing holes formed on the same plane facing the corresponding passing hole of the control electrode 4.

The focus electrode 6 is formed of a conductive plate having passing holes formed on the positions directly facing the passing holes of the signal modulation electrode 5. The horizontal deflection electrode 7 includes two conductive plates meshed with each other on a sectional portion and spaced apart by a predetermined distance on the same plane.

Further, the vertical deflection electrode 8 also includes two conductive plates meshed with each other on a sectional portion and spaced apart by a predetermined distance on the same plane.

Generally, all of the above-described electrodes are manufactured using an Invar (Fe—Ni alloy) in order to prevent an image quality from being degraded due to a thermal deformation. Each of the control electrode 4, the signal modulation electrode 5, the focus electrode 6, the horizontal deflection electrode 7 and the vertical deflection electrode 8 is joined with an insulating adhesive.

FIG. 2 is a view explaining a fluorescent screen of the conventional color flat panel display.

Referring to FIG. 2, a fluorescent screen 15 is formed on the front glass 9 and R, G and B fluorescent materials 12 are coated on an inner side of the front glass 9. Black matrixes (BM) 14 are formed between the fluorescent materials 12.

In addition, a metal back 13 is formed on the fluorescent materials 12 to thereby reflect and project a light generated by the fluorescent materials 12 on the front glass 9.

The flat panel display is manufactured using matrix deflection system (MDS) driving method to use a passive matrix manner of a flat panel display such as an LCD and a deflection manner implemented by a deflection yoke of CRT. The above-mentioned flat panel color display will be described in detail.

The rear electrode 2 is disposed at a front surface of the rear glass 1. A plurality of the filament cathodes 3 emitting electrons are disposed in the front of the rear electrode 2 in a horizontal direction.

If a voltage is applied to the filament cathode 3, electrons are emitted. At this time, the filament cathode 3 is heated by passing a current therethrough in order to easily cause the electron emission.

In other words, a proper voltage is applied to each of the rear electrode 2, the filament cathode 3, the control electrode 4 so that electrons are emitted from the surface of the filament cathode 3 according to child-langmuir law.

The electrons emitted from the filament cathode 3 are divided into multiple parts by the passing holes of the control electrode 4 and its amount is controlled.

A passing amount of the electron beam 11 passed through the control electrode 4 is controlled corresponding to an image signal at the signal modulation electrode 5.

The electron beam 11 passed through the signal modulation electrode 5 is focused at the passing holes of the focus electrode 6 due to a static lens effect. The electron beam 11 is deflected by passing both the horizontal deflection electrode 7 and the vertical deflection electrode 8 and then it is scanned to the fluorescent materials 12 of corresponding unit cell 10, thereby displaying a desired image.

At this time, a voltage applied to the electrode adjacent to the screen is maximally of 600 V and a voltage of the fluorescent screen 15 is approximately of 10,000–14,000 V.

In other words, since a high voltage of approximately 10,000 V is applied to the metal back 13, the electron beam 11 is accelerated to a high energy and collided against the metal back 13, thereby light-emitting the fluorescent materials 12.

On the other hand, since the width of the fluorescent material 12 of the fluorescent screen 15 is so wide and the width of BM 14 of the fluorescent screen 15 is so narrow that the horizontal size of the electron beam spot is formed smaller than the width of the fluorescent material 12 by 20%.

Thus, beam indexing is easy and color and brightness is changed little for mis-landing so that the above-mentioned technology is much better than the conventional CRT screen in view of beam indexing.

The beam shape made by electrode assembly is vertically elliptical. When a filament cathode 3 is used, line focusing should be performed. The electron beam emitted from the filament cathode 3 is emitted perpendicular to the control electrode 4 in a horizontal direction and emitted from a small area in a vertical direction. The electron beam is emitted spreading with a velocity component in radial direction.

Due to this velocity component, in electro-optical lens area formed by each electrode, there is weak converging in a horizontal direction and a strong converging in a vertical direction. In the vertical direction, a crossover is caused to make a big spot size on screen. In the horizontal direction, a small spot size is made on screen without causing any crossover. As a result, a vertically elliptical spot is formed.

Here, FIG. 3 illustrates a method of line focusing in a vertical direction in a flat panel color display according to the related art. FIG. 4 illustrates a method of line focusing in a horizontal direction in a flat panel color display according to the related art.

The operation of the flat panel color display according to the related art will be described.

As shown in FIG. 1, a plurality of filament cathodes 3 arranged in a horizontal direction is operated instantaneously according to a signal. The control electrode 4 in the front of the filament cathodes 3 draws electrons from the filament cathodes 3 according to the child-langmuir law. A signal modulation electrode 5 is arranged vertically, and controls the amount of electrons to control color and brightness.

A focus electrode 6 is positioned in the front of electron beam. A horizontal electrode 7 and a vertical electrode 8 are positioned in the focus electrode 6 to deflect the electron beam in horizontal and vertical directions.

On the fluorescent screen 15, the width of the fluorescent material is much wider than the size of the electron beam so that a little mis-landing does not deteriorate the brightness and other qualities.

At this time, the thickness of the electrodes is made by using an iron electrode formed using etching. The rear electrode 2 is formed using iron or carbon coating. A constant voltage is always applied to the rear electrode 2. The voltage heating a heater is applied to the filament cathode 3. A low voltage is applied to the filament cathode 3 abruptly to emit electrons. Here, the applied voltage is in the shape of pulse and synchronized to the pulse for vertical deflection.

The constant voltage is applied to the control electrode drawing electrons and allows the control electrode to control the amount of the emitted electrons according to child-langmuir law based on potential difference and distance.

The signal modulation electrode 5 is divided into a plurality of separated pieces of the same size and a pulse signal is applied to each pieces of the separated signal modulation electrode 5. The pulse signal is synchronized to the horizontal deflection electrode 7. The pulse width modulation (PWM) is used in which the pulse width varies according to the voltage.

In other words, the amount of electrons is controlled according to pulse width to control color and brightness.

A constant voltage is always applied to a focus electrode. The difference of the applied voltages between the signal modulation electrode 5 and the horizontal deflection electrode form electro-optical lens to converge the electron beam. This portion corresponds to a main of the conventional CRT.

The horizontal deflection electrode 7 is synchronized to the pulse signal inputted to the signal modulation electrode 5 and deflects the electron beam in a horizontal direction.

The vertical deflection electrode 8 is synchronized to the pulse signal inputted to the filament cathode 3 and deflects the electron beam in a vertical direction.

FIG. 5 illustrates a method for correcting mis-landing in a flat panel display according to the related art. FIG. 6 illustrates a method for correcting color and brightness in a flat panel display according to the related art.

Referring to FIGS. 5 and 6, there are correction systems to control mis-landing, color and brightness by controlling the amplitude or pulse width of a pulse signal inputted to the signal modulation electrode 5 and the horizontal electrode 7. The first system controls the amplitude of the pulse inputted to the horizontal deflection electrode 7 to optimize mis-landing entirely. The second system controls the width of the pulse inputted to the signal modulation electrode 5 to control color and brightness.

FIG. 5 shows that the amplitude of the pulse is controlled to correct the mis-landing of electron beam. FIG. 6 shows that the width of the pulse is controlled to control color and brightness.

Aperture size and potential created on the horizontal deflection electrode 7 are related to focusing of electron beam. Accordingly, shape and potential of the electrodes is very critical.

FIG. 7 illustrates a horizontal deflection electrode in a flat panel display according to the related art.

The main skeletal structure 71 of the horizontal deflection electrode 7 is arranged horizontally and a hook-shaped electrode is projecting in the structure. Positive (+) voltage is applied to an end of the hook-shaped electrode and negative (−) voltage is applied to the adjacent electrode.

On the electron beam deflection area on which such a horizontal deflection electrode 7 is formed, electron beam is focused too much when the potential is generated asymmetrically deflected. However, the intensity is provided.

FIG. 8 illustrates another configuration of a horizontal deflection electrode 7 in a flat panel display according to the related art. Referring to FIG. 8, main skeletal structure 76 and 77 is formed to be vertical. A pair of an electrode to which positive (+) voltage is applied and an electrode to which negative (−) voltage is applied deflects electron beam horizontally.

As shown in FIG. 8, in such a structure, an electron deflection area makes symmetry-shaped potential distribution and weak structural strength.

In other words, in the flat panel color display, one cell roles two trios, that is, R-G-B-R-G-B in a horizontal direction and roles ten lines in a vertical direction so that the size of one cell is 5 mm in a vertical direction and 1.2 mm in a horizontal direction.

Accordingly, when the main skeletal structure is formed in a horizontal direction, it can be designed that the structure has a wide width. However, when the main skeletal structure 76 and 77 is formed in a vertical direction, the structure has a narrow width.

The difference between structures shown in FIGS. 7 and 8 is as follows. The electrode structure shown in FIG. 7 is strong but makes asymmetry-shaped potential to need one additional electrode to compensate for this. The electrode structure shown in FIG. 8 has electrode in symmetry and makes symmetry-shaped potential to reduce the number of electrode but its structural strength is so weak that it cannot be employed in large area.

Additionally, referring to FIG. 7, in the main skeletal structure 71, the widths of projecting hook-shaped portions 72 and 74 extend the same so that it is weak structure if the projecting portion is long. The projecting portions 72 and 74 can contact bent portions 73 and 75 in their manufacturing procedure. So, they are required to be separated with long distance.

In the other words, when the projecting portions 72 and 74 are in contact with the bent portions 73 and 75, an electrical potential difference cannot be generated, so that deflection by electric force cannot be realized, which is a fatal disadvantage to the display device.

SUMMARY OF THE INVENTION

Accordingly, the present invention is directed to a flat panel display that substantially obviates one or more problems due to limitations and disadvantages of the related art.

An object of the present invention is to provide a flat panel display in which the main skeletal structure of a horizontal deflecting electrode is arranged in a horizontal direction to enhance structural strength, and the structure of an electrode part to which voltage is applied is shaped symmetric and a stable potential is applied to the electrode part to eliminate over-converging of electron beam.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a flat panel display comprises: filament cathodes, a control electrode, signal modulation electrode, a focusing electrode, a horizontal deflection electrode, a vertical deflection electrode and a fluorescent screen on which fluorescent material is coated, wherein the horizontal deflection electrode has an electron beam deflection area formed by a plurality of electrodes to which different voltages are applied, the electron beam deflection area is X-axis symmetric, Y-axis symmetric and point symmetric, and the electron beam deflection areas are connected to each other in a horizontal direction.

In another aspect of the present invention, a flat panel display comprises: filament cathodes, a control electrode, signal modulation electrode, a focusing electrode, a horizontal deflection electrode, a vertical deflection electrode and a fluorescent screen on which fluorescent material is coated, wherein a main skeletal structure of the horizontal deflection electrode is formed in a horizontal direction, projecting hook-shaped electrodes in the main skeletal structure includes a projecting portion connected to the main skeletal structure and a bent portion bent in a horizontal direction, and an inside of the hook-shaped electrodes is X-axis symmetric, Y-axis symmetric and point symmetric with respect to center thereof.

An interior of the hook-shaped electrode is rectangular in shape.

An interior of the hook-shaped electrode is elliptical in shape.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of a horizontal deflection electrode in a flat panel display according to the present invention, examples of which are illustrated in the accompanying drawings.

Figure 9:
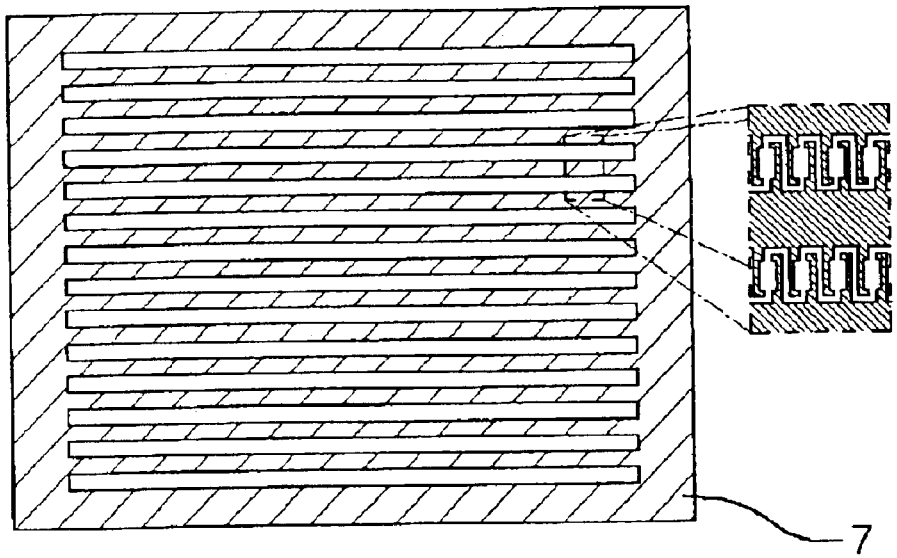
FIG. 9 illustrates a horizontal deflection electrode in a flat panel display according to the present invention.
Figure 9:
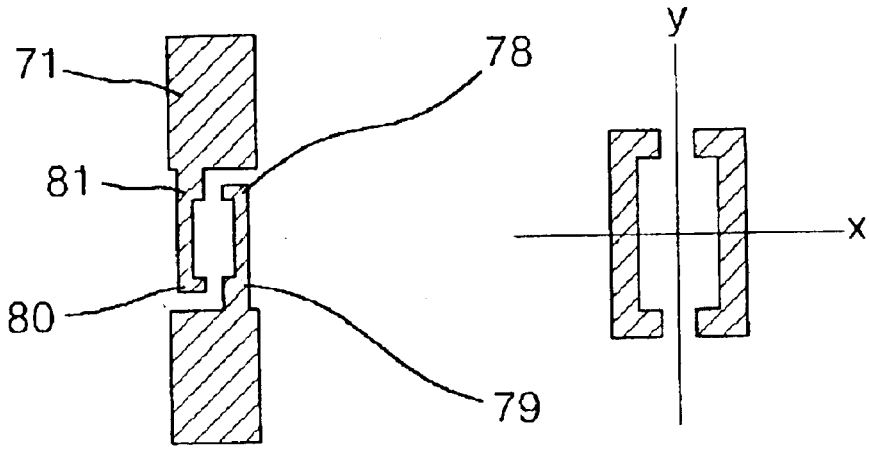

FIG. 9 illustrates a horizontal deflection electrode in a flat panel display according to the present invention.

Referring to FIG. 9, the horizontal deflection electrode 7 of the present invention has a main skeletal structure 71 arranged in a horizontal direction and its width is formed to be wide. A hook-shaped electrode is formed in the main skeletal structure 71. A voltage is applied to the hook-shaped electrode.

Here, the hook-shaped electrode extends from the main skeletal structure. The widths of projecting portions 79 and 81 that meet the main skeletal structure 71 are formed wide so that an electron beam deflection area formed by two electrodes which receive different voltages is formed not only to be symmetric (X-axis symmetric, Y-axis symmetric) but also to be point symmetric. As seen in FIG. 9, the respective projecting portions 79 and 81 are point symmetric about the point defined by the intersection of the X-axis and the Y-axis shown. Specifically, any portion of the projecting portion 79 is substantially symmetrical to an opposite portion of the same projecting portion 79 lying in an opposite quadrant, e.g., the first and the third quadrants of the X-axis and the Y-axis grid, and in an adjacent quadrant, e.g., the first and the second quadrants of the X-axis and the Y-axis grid. In further contrast to the vertically oriented structure shown in FIG. 8, the symmetrical potential formed is provided by electron beam deflection areas that are connected to each other along a horizontal direction (see FIG. 9) and not a vertical direction (see FIG. 8).

Comparatively high voltage is applied to one end of the horizontal deflection electrode 7 formed as shown in FIG. 9 and comparatively low voltage is applied to the other end of the horizontal deflection electrode 7

Figure 1:
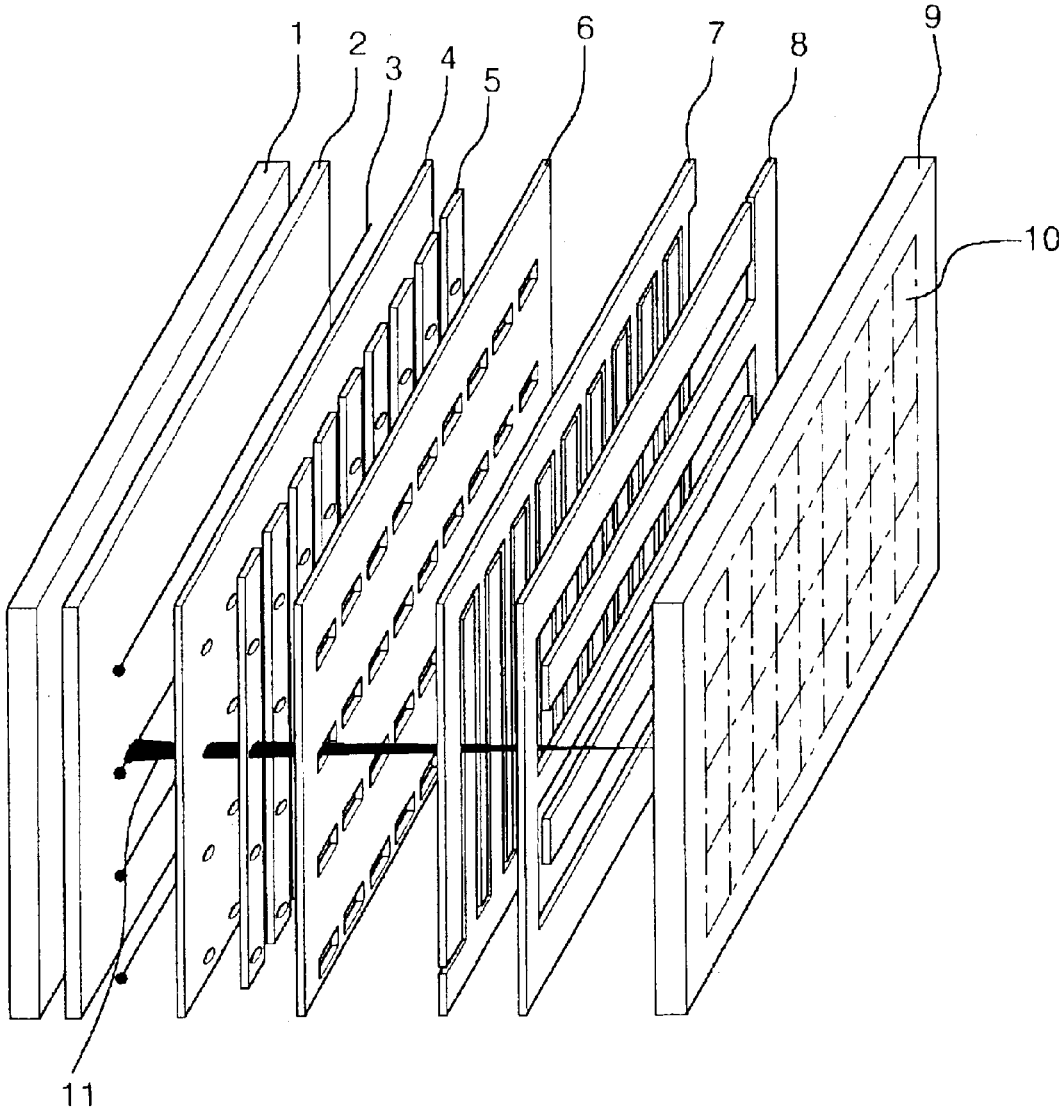
FIG. 1 (Related Art)
FIG. 1 illustrates a conventional color flat panel display based on a screen scanning of an electron beam.
Figure 2:
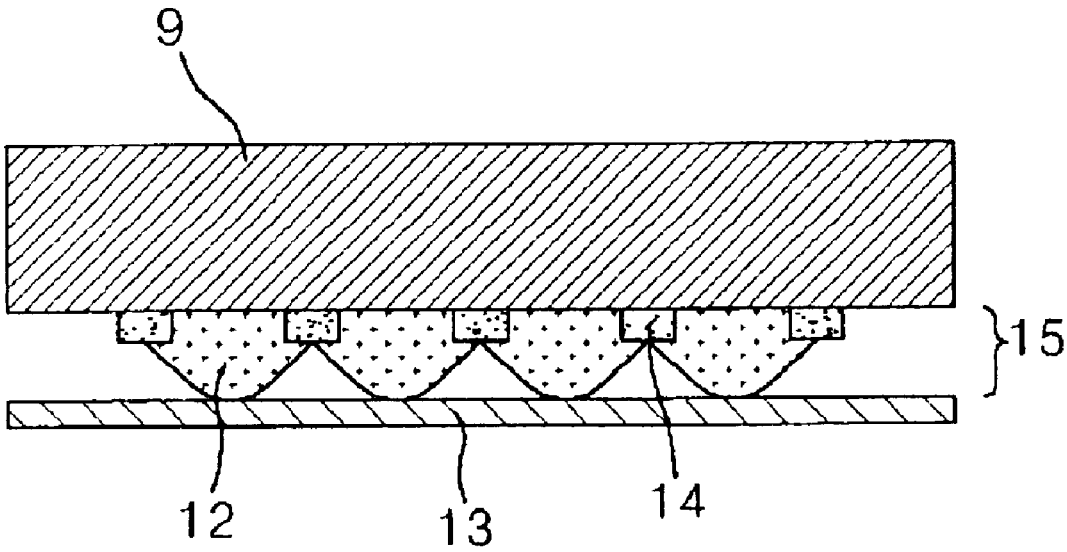
FIG. 2 (Related Art)
FIG. 2 illustrates a fluorescent screen of the conventional color flat panel display.
Figure 3:
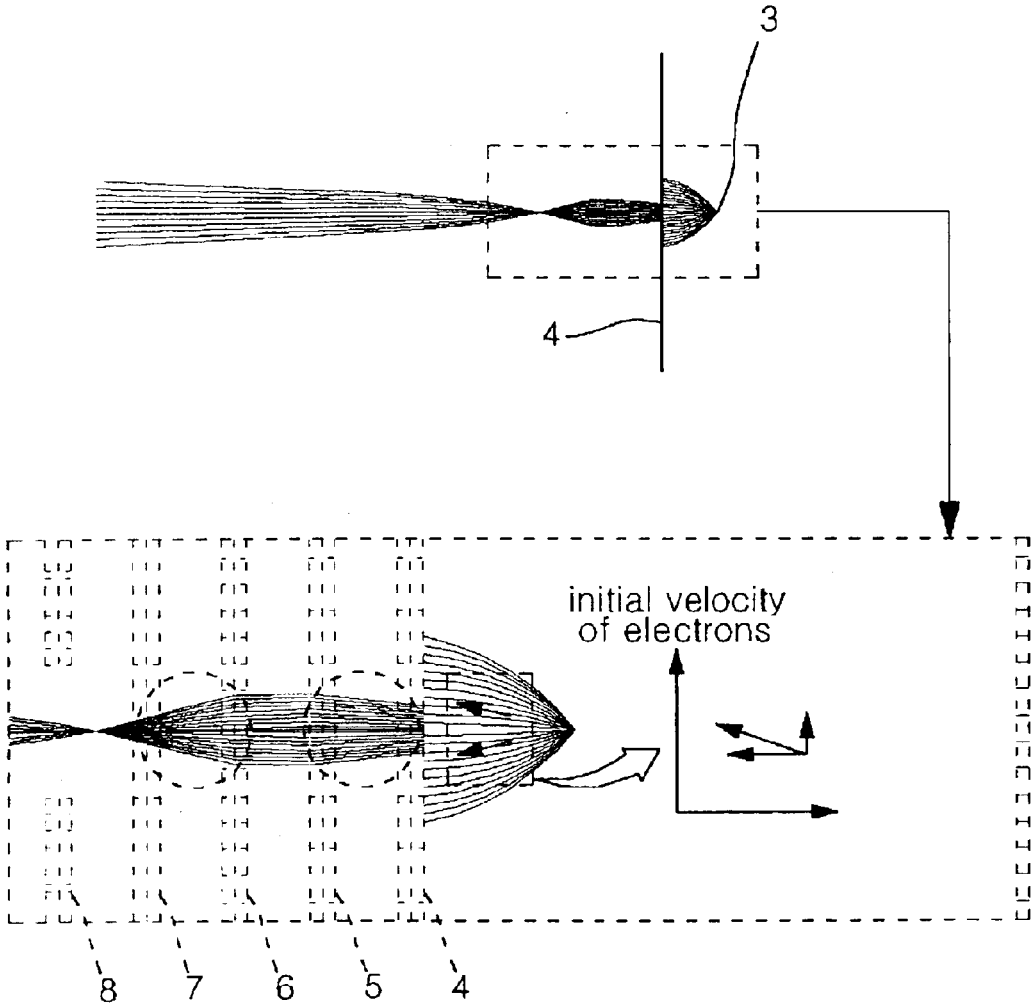
FIG. 3 (Related Art)
FIG. 3 illustrates a method of line focusing in a vertical direction in a flat panel color display according to the related art.
Figure 4:
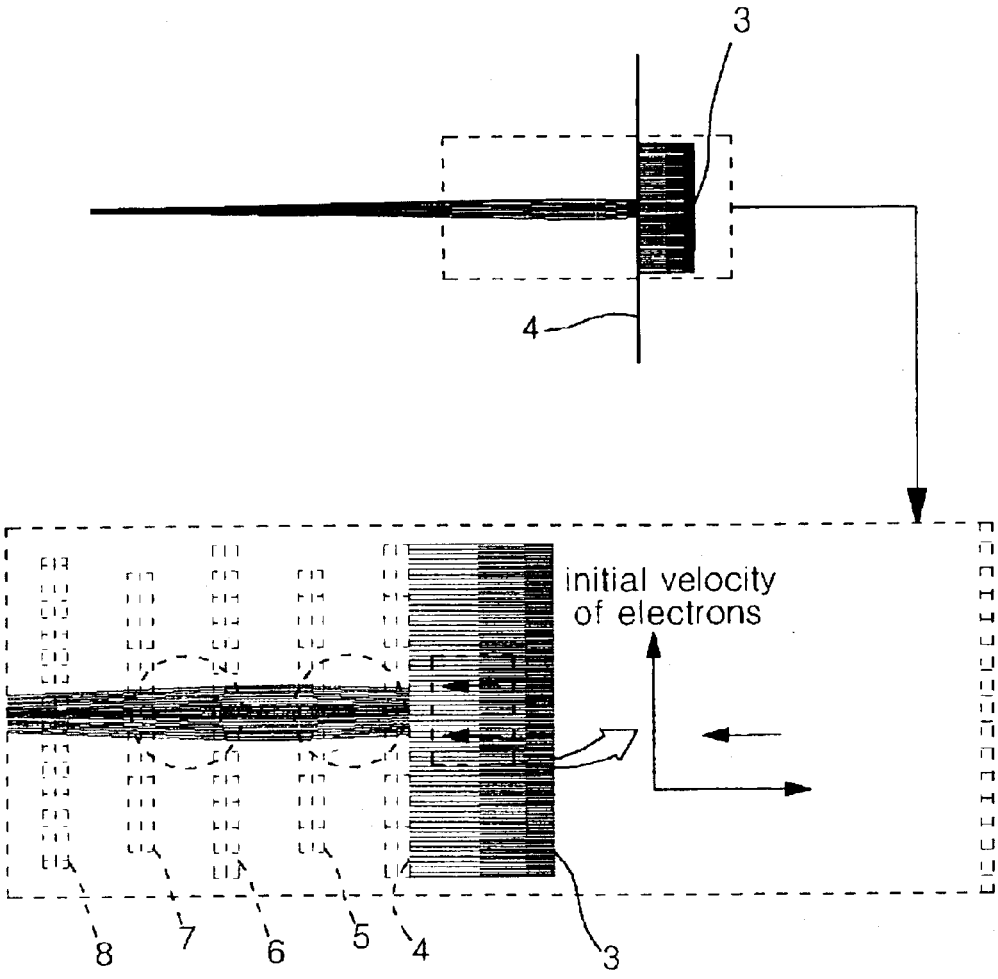
FIG. 4 (Related Art)
FIG. 4 illustrates a method of line focusing in a horizontal direction in a flat panel color display according to the related art.
Figure 5:
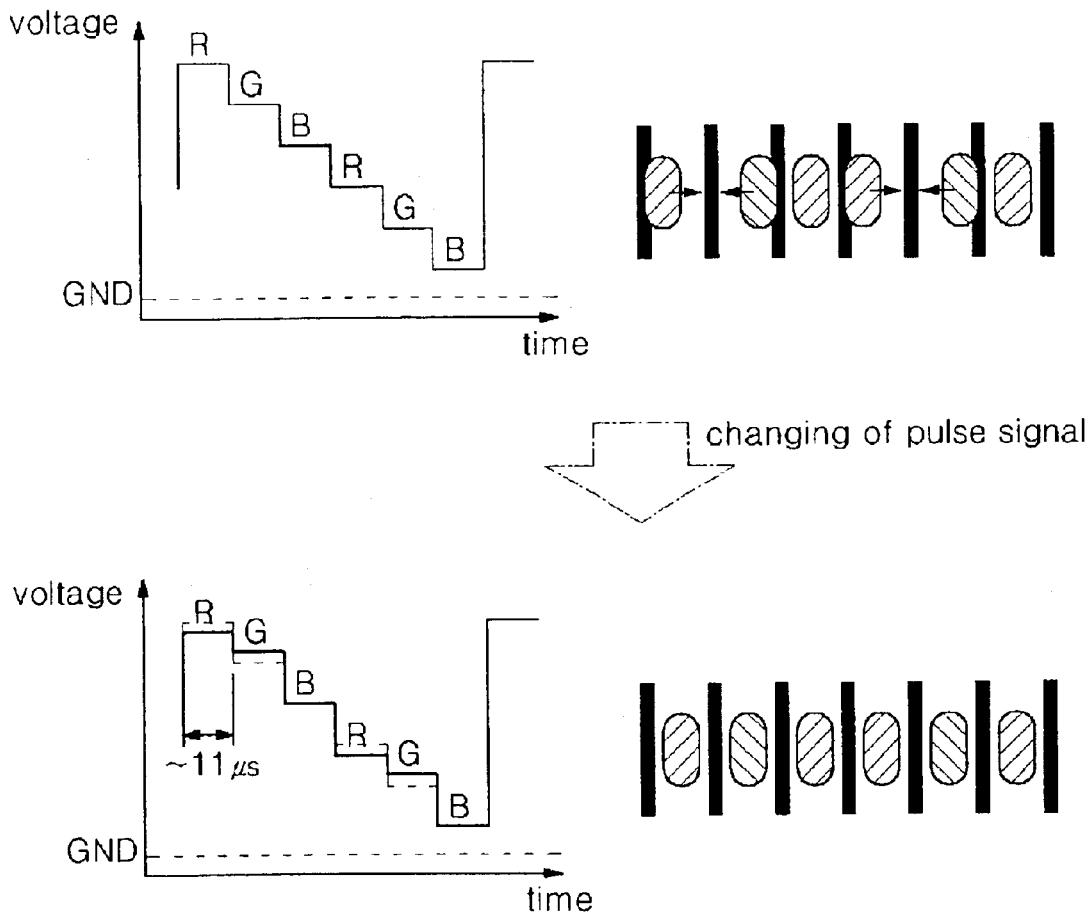
FIG. 5 (Related Art)
FIG. 5 illustrates a method for correcting mis-landing in a flat panel display according to the related art.
Figure 6:
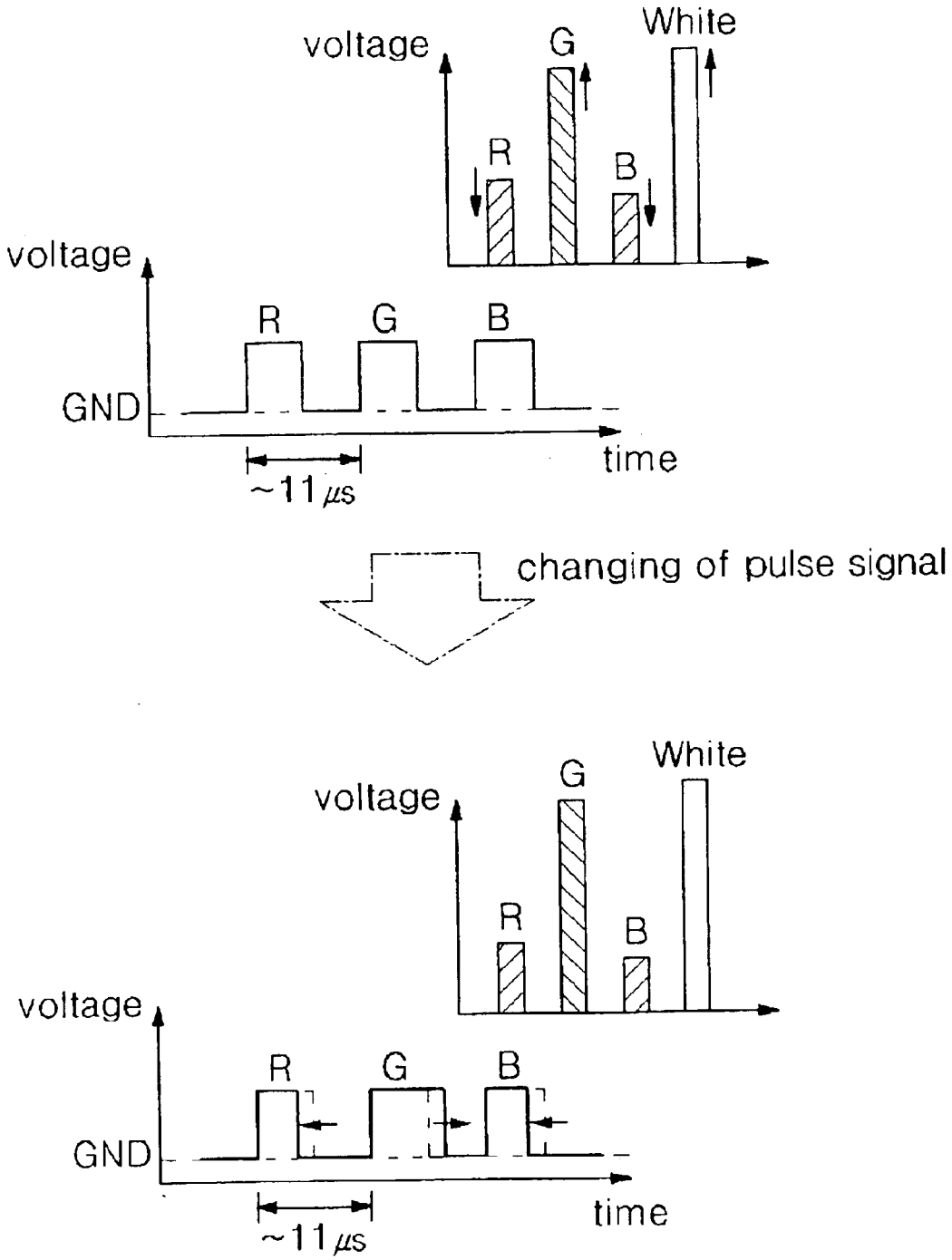
FIG. 6 (Related Art)
FIG. 6 illustrates a method for correcting color and brightness in a flat panel display according to the related art.
Figure 7:
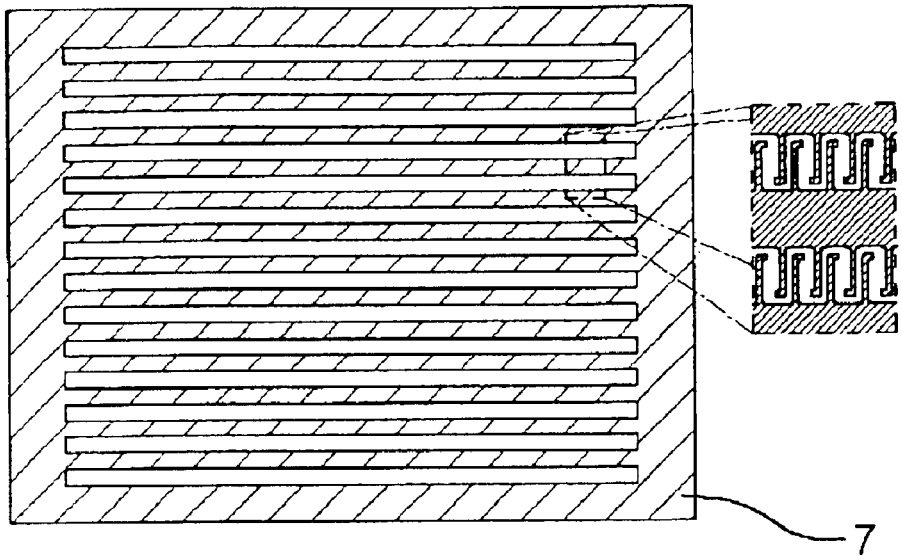
FIG. 7 (Related Art)
FIG. 7 illustrates a horizontal deflection electrode in a flat panel display according to the related art.
Figure 7:
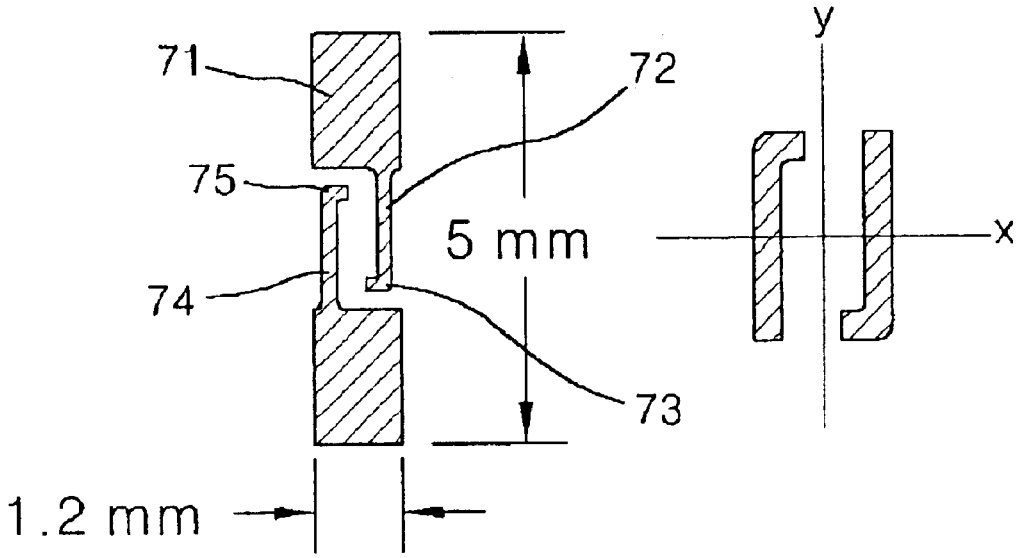
FIG. 7 (Related Art)

In the related art illustrated in FIG. 7, asymmetric potential is formed around the electrode while, in the present invention, symmetric potential is formed.

Figure 8:
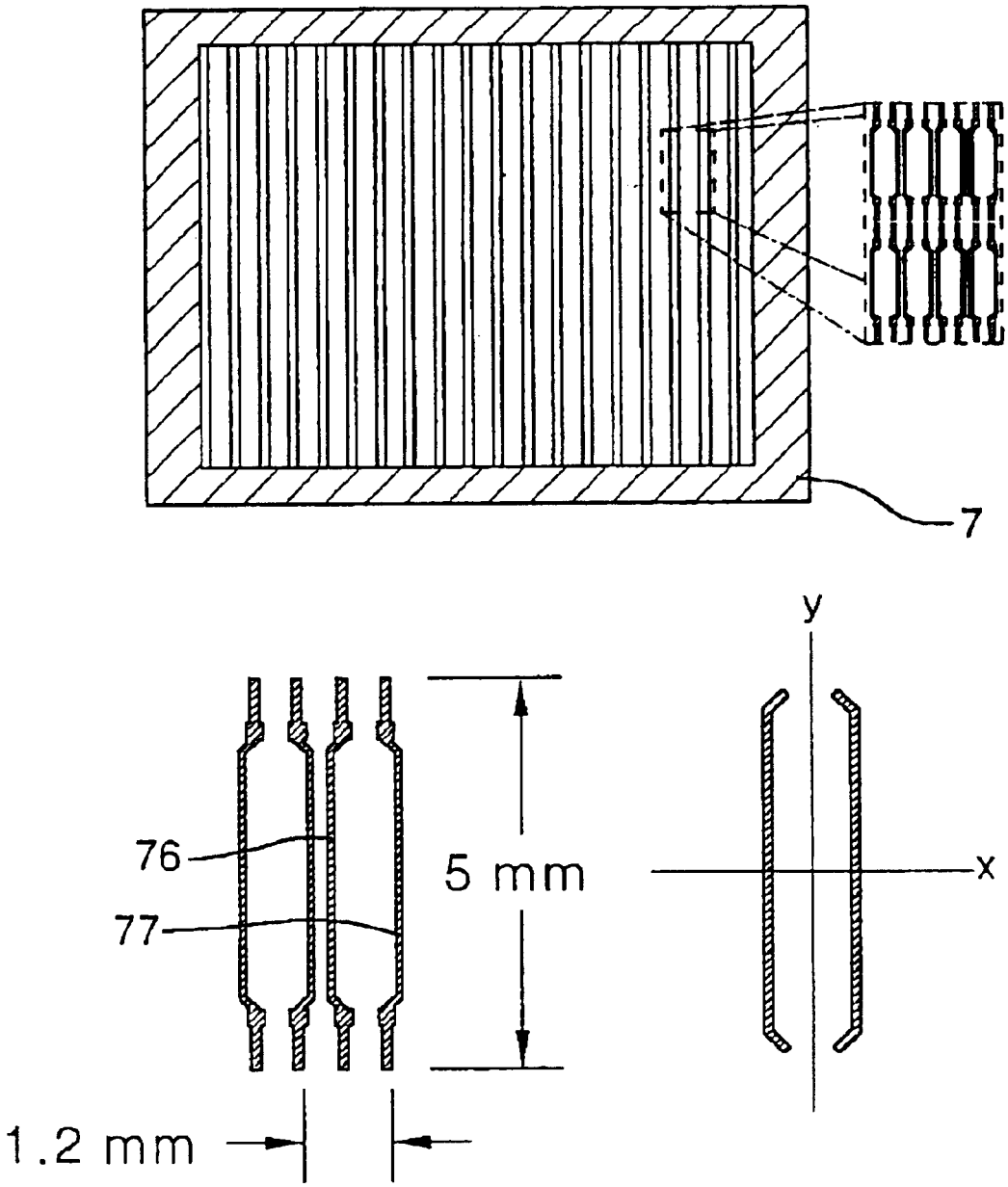
FIG. 8 (Related Art)
FIG. 8 illustrates another configuration of a horizontal deflection electrode 7 in a flat panel display according to the related art.

In the related art illustrated in FIG. 8, symmetric potential is formed around the electrode, but the main skeletal structure 76 and 77 are formed in the vertical direction and the width of the main skeletal structure 76 and 77 is so narrow that structural strength is low.

However, in the present invention, the main skeletal structure 71 is formed in a horizontal direction and the width of the main skeletal structure 71 is wide so that structural strength is strong.

In addition, in the present invention, symmetric potential is formed. So, a separate electrode for correcting the potential when the potential is asymmetric is removed, thereby simplifying the structure of the flat panel display. The main skeletal structure is formed in a horizontal direction to have a strong structural strength, so that the present invention is easy to adapt to a large sized flat panel display.

Further, the widths of the projecting portions 79 and 81 projecting from the main skeletal structure 71 are formed to be wide so that the partial structural strength of the hook-shaped electrode is strong. The end of the hook-shaped electrode, that is, the end of the bent portion 78 and 80 is hardly in contact with the projecting portion 79 and 81 in manufacturing procedure.

Figure 10:
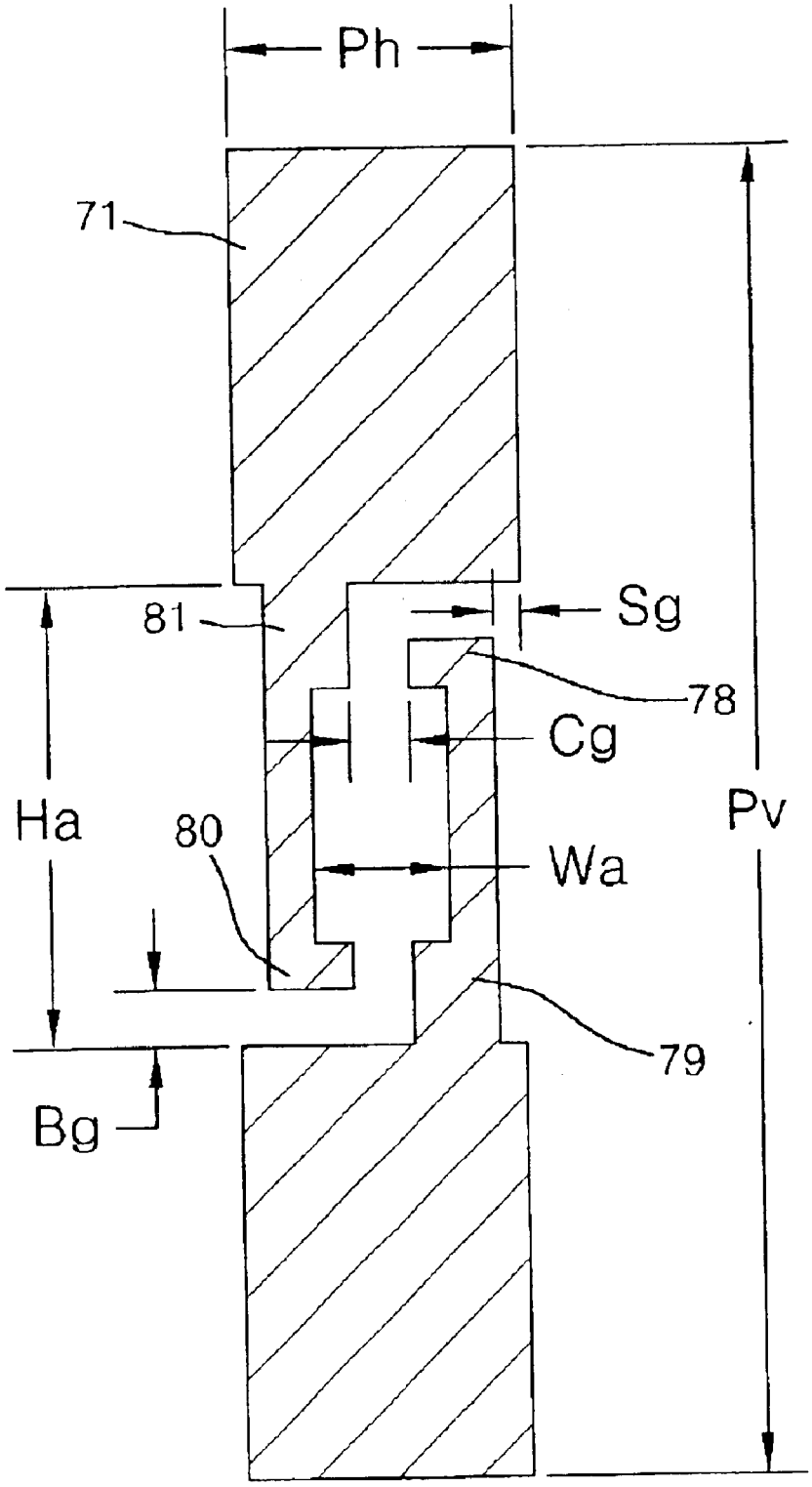
FIG. 10 is a detailed view illustrating a horizontal deflection electrode in a flat panel display according to the present invention.

As an embodiment of the present invention, a horizontal deflection electrode is shown in FIG. 10.

FIG. 10 is a detailed view illustrating the horizontal deflection electrode shown in FIG. 8.

Reviewing the dimension of the horizontal deflection electrode with reference to FIG. 10, Ph=1.26 mm, Pv=4.80 mm, Ha=2.20 mm, Wa=0.72 mm, Bg=0.10 mm, Cg=0.10 mm, Sg=0.05 mm.

It is designed that each of Bg and Cg has an interval of 100 $\mu$m in order to eliminate a contact danger in the manufacturing process.

Considering the current etching technology, an error of 50 $\mu$m can be caused, but the secured interval of 100 $\mu$m is sufficient to avoid any problem in the assembly process.

Figure 11:
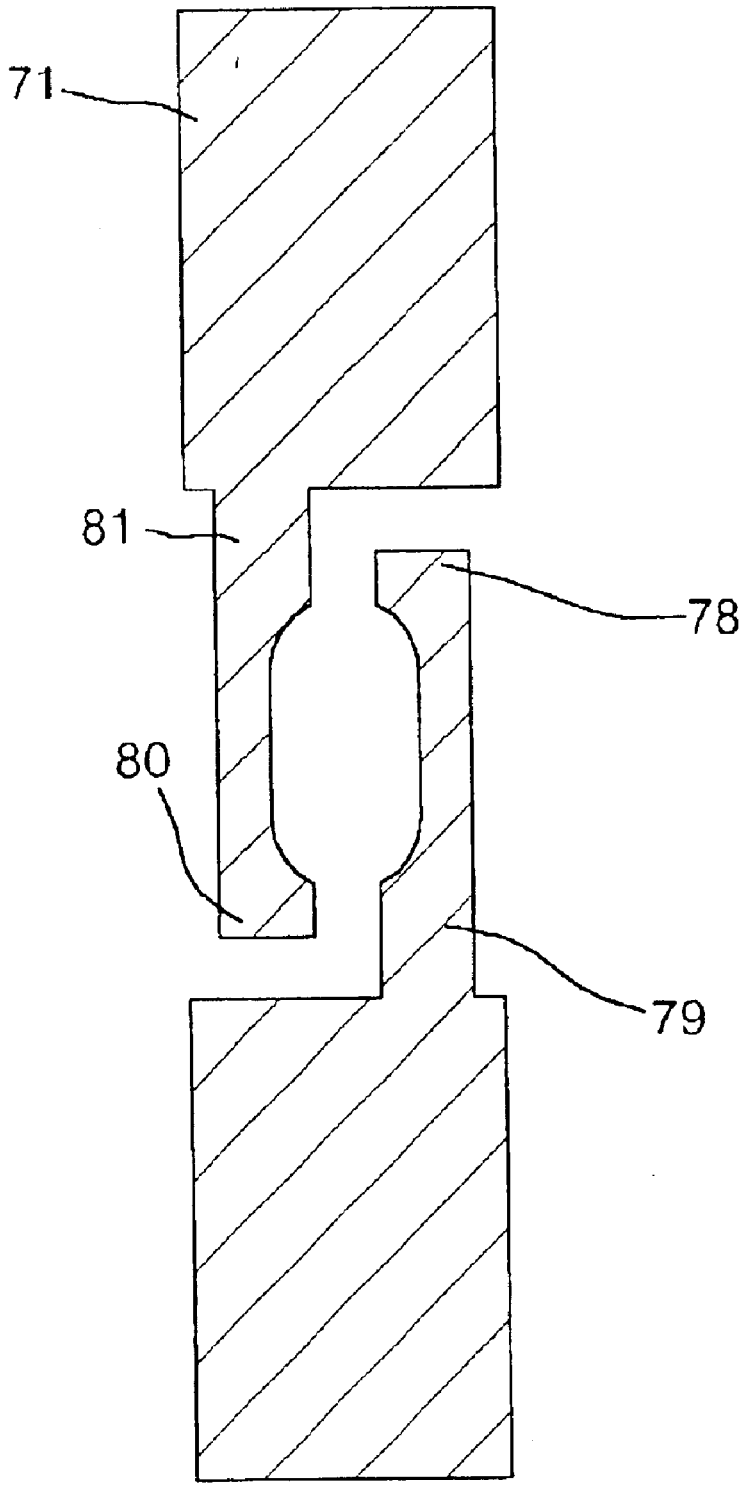
FIG. 11 is another embodiment of a horizontal deflection electrode in a flat panel display according to the present invention.

As another embodiment, as shown in FIG. 11, hook-shaped electrodes facing each other each has a concave inner surface and an angled outer surface.

Also, the width of the projecting portion 79 and 81 projecting from the main skeletal structure 71 is formed wide to strengthen the partial structural strength of the hook-shaped electrode, and the ends of the hook-shaped electrodes, e.g., the ends of the bent portions 78 and 80, are hardly in contact with the projecting portions 79 and 81 in the manufacturing process.

The hook-shaped electrodes extend from the main skeletal structure 71. The widths of the projecting portions 79 and 81 meeting the main skeletal structure 71 are made wide so that the electrode deflection area formed by two electrodes to which different voltages are applied is formed to be not only symmetric (X-axis symmetric, Y-axis symmetric) and also point symmetric.

In the related art, six or seven metal sheets are needed when using the asymmetry-shaped electrode. Also, although only five metal sheets can be used, the structural strength is very weak, which is problematic to make a large-sized flat panel display. However; the application of the horizontal deflection electrode according to the present invention allows the number of electrodes to be reduced and enables to secure a sufficient structural strength. Accordingly, the present invention can be applied to both of small-sized flat panel display and large-sized flat panel display. The reduction in the number of electrodes leads to lowered material costs. Further, in the present invention, symmetric potential is applied to obtain a spot of good quality.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A flat panel display comprising:

at least one filament cathode, a control electrode, a signal modulation electrode, a focusing electrode, a horizontal deflection electrode, a vertical deflection electrode, and a fluorescent screen on which fluorescent material is coated, wherein the horizontal deflection electrode has an electron beam deflection area formed by a plurality of electrodes to which different voltages are applied, the electron beam deflection area is X-axis symmetric and Y-axis symmetric, and the electron beam deflection areas are connected to each other along a horizontal direction, and wherein the electron beam deflection areas are separated vertically, the electron beam deflection areas being formed by a plurality of electrodes to which different voltages are applied.

2. A flat panel display comprising:

at least one filament cathode, a control electrode, a signal modulation electrode, a focusing electrode, a horizontal deflection electrode, a vertical deflection electrode and a fluorescent screen on which fluorescent material is coated, wherein the horizontal deflection electrode has an electron beam deflection area formed by a plurality of electrodes to which different voltages are applied, the electron beam deflection area is X-axis symmetric and Y-axis symmetric, and the electron beam deflection areas are connected to each other in a horizontal direction, wherein the horizontal deflection electrode has a main skeletal structure arranged in a horizontal direction, and comprises a plurality of hook-shaped electrodes consisting of a first group of electrodes each having a hook-shaped bent portion arranged upward and a second group of electrodes each having a hook-shaped bent portion arranged downward, the first group of electrodes oppositely facing the second group of electrodes in symmetry.

3. The flat panel display according to claim 2, wherein the hook-shaped electrode has an interior shaped in the form of a rectangle.

4. The flat panel display according to claim 2, wherein the hook-shaped electrode has an interior shaped in the form of an ellipse.

5. A flat panel display comprising filament cathodes, a control electrode, signal modulation electrode, a focusing electrode, a horizontal deflection electrode, a vertical deflection electrode and a fluorescent screen on which fluorescent material is coated, wherein the horizontal deflection electrode has a main skeletal structure arranged in a horizontal direction, a hook-shaped electrode projecting from the main skeletal structure includes a projecting portion connected to the main skeletal structure and a bent portion bent in the horizontal direction, and an inside of the hook-shaped electrode is X-axis symmetric, Y-axis symmetric and point symmetric with respect to center thereof.

6. The flat panel display according to claim 5, wherein an interior of the hook-shaped electrode is rectangular in shape.

7. The flat panel display according to claim 5, wherein an interior of the hook-shaped electrode is elliptical in shape.

* * * * *